US007259371B2

(12) United States Patent
Collings et al.

(10) Patent No.: US 7,259,371 B2
(45) Date of Patent: Aug. 21, 2007

(54) METHOD AND APPARATUS FOR IMPROVED SENSITIVITY IN A MASS SPECTROMETER

(75) Inventors: Bruce A. Collings, Bradford (CA); Thomas R. Covey, Richmond Hill (CA); Mircea Guna, Toronto (CA); Hassan Javaheri, Richmond Hill (CA); Alexandre V. Loboda, Toronto (CA); Bradley B. Schneider, Bradford (CA); Bruce A. Thomson, Toronto (CA)

(73) Assignees: Applera Corporation, Framingham, MA (US); MDS Inc., Concord, Ontario (CA)

( * ) Notice: Subject to any disclaimer, the term of this patent is extended or adjusted under 35 U.S.C. 154(b) by 0 days.

(21) Appl. No.: 11/315,788

(22) Filed: Dec. 22, 2005

(65) Prior Publication Data

US 2006/0169891 A1 Aug. 3, 2006

Related U.S. Application Data

(63) Continuation-in-part of application No. 11/032,376, filed on Jan. 10, 2005.

(51) Int. Cl.
*H01J 49/00* (2006.01)

(52) U.S. Cl. ..... 250/288; 250/281; 250/282

(58) Field of Classification Search ..... 250/288
See application file for complete search history.

(56) References Cited

U.S. PATENT DOCUMENTS 4,121,099 A 10/1978 French et al.
4,542,293 A 9/1985 Fenn et al.
5,298,743 A * 3/1994 Kato ..... 250/288
5,652,427 A 7/1997 Whitehouse et al.
5,973,322 A 10/1999 Rockwood
6,011,259 A 1/2000 Whitehouse et al.
6,107,628 A 8/2000 Smith et al.
6,528,784 B1 3/2003 Tang et al.

FOREIGN PATENT DOCUMENTS

WO WO98/52682 A 11/1998
WO WO02/097857 A 12/2002

OTHER PUBLICATIONS

Ashkenas et al. "Experimental Methods in Rarefied Gas Dynamics", Supersonic Free Jets—Structure and Utilization, pp. 84-105.

(Continued)

*Primary Examiner*—David Vanore
(74) *Attorney, Agent, or Firm*—Andrew T. Karnakis

(57) ABSTRACT

In a mass spectrometer, ions from an ion source pass through an inlet aperture into a vacuum chamber for transmitting prior to mass analysis by the mass analyzer. The configuration of the inlet aperture forms a sonic orifice or sonic nozzle and with a predetermined vacuum chamber pressure, a supersonic free jet expansion is created in the vacuum chamber that entrains the ions within the barrel shock and Mach disc. Once formed, at least one ion guide with a predetermined cross-section to essentially radially confine the supersonic free jet expansion can focus the ions for transmission through the vacuum chamber. This effectively improves the ion transmission between the ion source and the mass analyzer.

20 Claims, 15 Drawing Sheets

OTHER PUBLICATIONS

Campargue, Roger, "Aerodynamic Separation Effect on Gas and Isotope Mixtures Induced by Invasion of the Free Jet Shock Wave Structure", The Journal of Chemical Physics, vol. 52, No. 4, Feb. 15, 1970, pp. 1795-1802.

Dodonov et al., "A New Technique for Decomposition of Selected Ions in Molecule Ion Reactor Coupled with Ortho-Time-of-flight Mass Spectrometry", Rapid Communications in Mass Spectrometry, vol. 11., 1649-1656 (1997).

Douglas et al., "Gas Dynamics of the Inductively Cupled Plasma Mass Spectrometry Interface", Journal of Analytical Atomic Spectrometry, Sep. 1988, vol. 3, pp. 743-747.

Fenn, John B., "Mass spectrometric implications of high-pressure ion sources", International Journal of Mass Spectrometry 200 (2000) pp. 459-478.

PCT/US2006/000492 International Search Report mailed May 9, 2007.

Bondarenko, P.V. et al, "A new electrospray-ionization time-of-flight mass spectrometer with electrostatic wire ion guide", International Journal of Mass Spectrometry and Ion Processes, Elsevier Scientific Publishing Co. Amsterdam, NL, vol. 160, No. 1, Jan. 1997, pp. 241-258.

Krutchinsky, A.N. et al, "Collisional Damping Interface for an Electrospray Ionization Time-of-Flight Mass Spectrometer", Journal of the American Society for Mass Spectrometry, Elsevier Science Inc., US. vol. 9, No. 6, Jun. 1998, pp. 569-579.

Niessen, W.M.A., "Advances in instrumentation in liquid chromatography-mass spectrometry and related liquid-introduction techniques", Journal of Chromatography A, Elsevier, Amsterdam, NL, vol. 794, No. 1-2, Jan. 23, 1998, pp. 407-435.

Tolmachev, A.V. et al, "Simulation-based optimization of the electrodynamic ion funnel for high sensitivity electrospray ionization mass spectrometry", International Journal of Mass Spectrometry, Elsevier Science Publishers, Amsterdam NL, vol. 203, No. 1-3, Dec. 26, 2000, pp. 31-47.

* cited by examiner

PRIOR ART

METHOD AND APPARATUS FOR IMPROVED SENSITIVITY IN A MASS SPECTROMETER

CROSS REFERENCE TO RELATED APPLICATION

This application is a continuation-in-part of U.S. application Ser. No. 11/032,376 filed Jan. 10, 2005 entitled "Method and Apparatus for Improved Sensitivity in a Mass Spectrometer System".

FIELD

The present teachings relate to method and apparatus for transmitting ions for the detection of ions in a sample.

INTRODUCTION

One application for mass spectrometry is directed to the study of biological samples, where sample molecules are converted into ions, in an ionization step, and then detected by a mass analyzer, in mass separation and detection steps. Various types of ionization techniques are presently known, which typically create ions in a region of nominal atmospheric pressure. Mass analyzers which can be quadrupole analyzers where RF/DC ion guides are used for transmitting ions within a narrow slice of mass-to-charge ratio (m/z) values, magnetic sector analyzers where a large magnetic field exerts a force perpendicular to the ion motion to deflect ions according to their m/z and time-of-flight ("TOF") analyzers where measuring the flight time for each ion allows the determination of its m/z. The mass analyzer generally operates in a low-pressure environment typically requiring its placement in one or more differentially pumped vacuum chambers equipped with inter-chamber apertures that provide adjacent pressure separation. One or more apertures positioned between the ionization step and the mass analyzer vacuum chamber generally define the interface for transmitting ions to the mass analyzer.

SUMMARY

In view of the foregoing, the present teachings provide an apparatus for transmitting ions for the detection of ions in a sample. The apparatus comprises an ion source for generating ions, from the sample, in a high-pressure region, for example, at atmospheric pressure, and a vacuum chamber for receiving the ions. The vacuum chamber has an inlet aperture for passing the ions from the high-pressure region into the vacuum chamber. In conjunction with the differential pressure, the diameter of the inlet aperture is sized to provide a supersonic free jet expansion, with a predefined barrel shock and Mach disc, to entrain the ions into the vacuum chamber. The apparatus also comprises at least one ion guide with a predetermined cross-section that is sized to radially confine the supersonic free jet expansion so as to capture essentially all of the ions. The ion guide can be positioned in the chamber between the inlet aperture and an exit aperture so that when RF voltage, supplied by a RF power supply, is applied to the ion guide, the ions in the supersonic free jet can be focused and directed to the exit aperture. In various embodiments, the inlet aperture can be of the type that comprises a sonic nozzle or sonic orifice and the ion guide can be a multipole ion guide.

The present teachings also provide a method for transmitting ions for the detection of ions in a sample. The method comprises providing an ion source, in a high-pressure region, for example, at atmospheric pressure, for generating ions from the sample, and a vacuum chamber positioned downstream of the ion source for receiving the ions. The vacuum chamber is provided with an inlet aperture for passing the ions from the high-pressure region into the vacuum chamber. In conjunction with the differential pressure, the method comprises sizing the diameter of the inlet aperture for providing a supersonic free jet expansion having a predefined barrel shock and a Mach disc. The ions, which pass through the inlet aperture, are entrained by the supersonic free jet expansion created in the vacuum chamber. The method further comprises providing at least one ion guide with a predetermined cross-section that is sized to radially confine the supersonic free jet expansion so as to capture essentially all of the ions. The ion guide can be positioned in the chamber between the inlet aperture and an exit aperture so that when RF voltage, supplied by a RF power supply, is applied to the ion guide, the ions in the supersonic free jet are focused and directed towards the exit aperture.

These and other features of the present teachings are set forth herein.

BRIEF DESCRIPTION OF THE DRAWINGS

The skilled person in the art will understand that the drawings, described below, are for illustration purposes only. The drawings are not intended to limit the scope of the present teachings in any way.

In the accompanying drawings.

In the drawings, like reference numerals indicate like parts.

DESCRIPTION OF VARIOUS EMBODIMENTS

Figure 1:
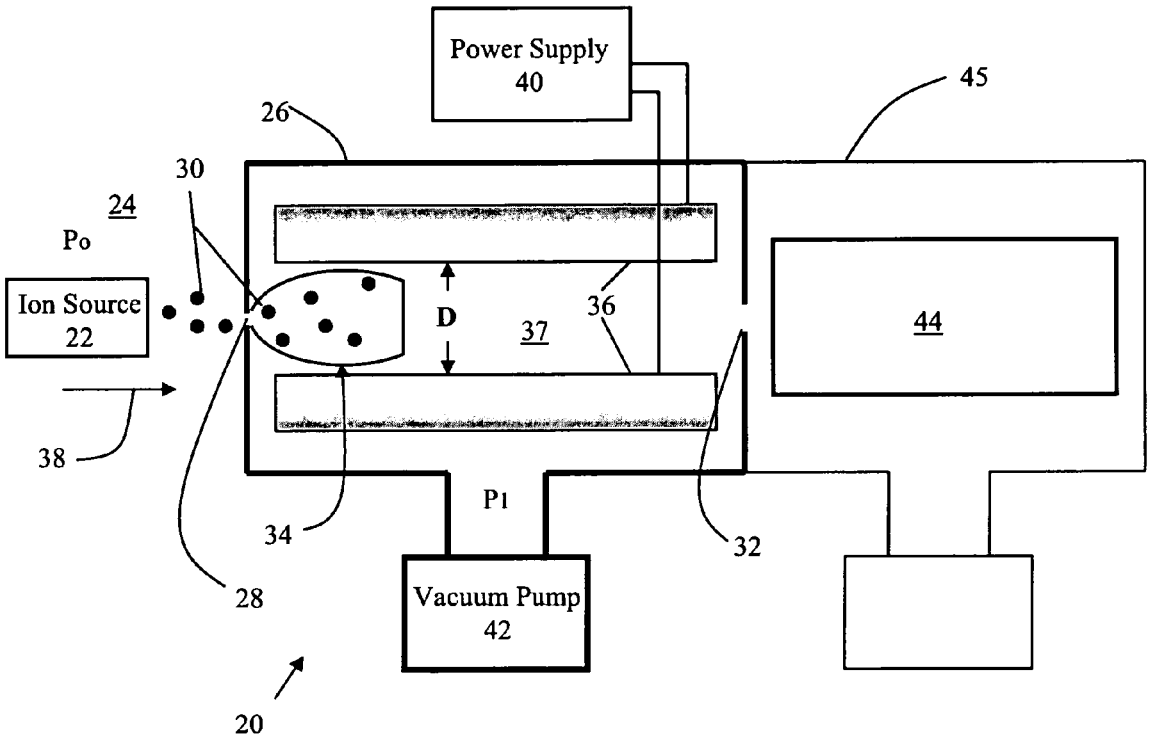
FIG. 1 is a schematic view of a mass spectrometer according to the present teachings.
Figure 5:
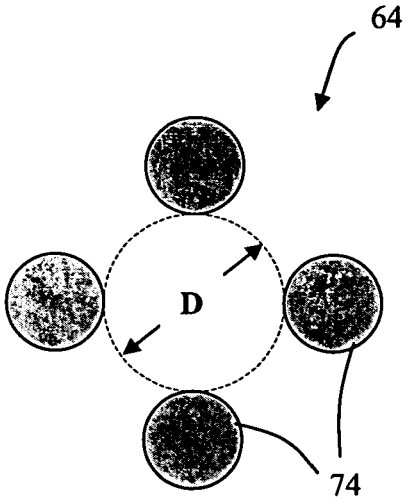
FIGS. 5 to 10 are schematic and schematic cross-section views of various embodiments of the ion guide according to the present teachings.
Figure 6:
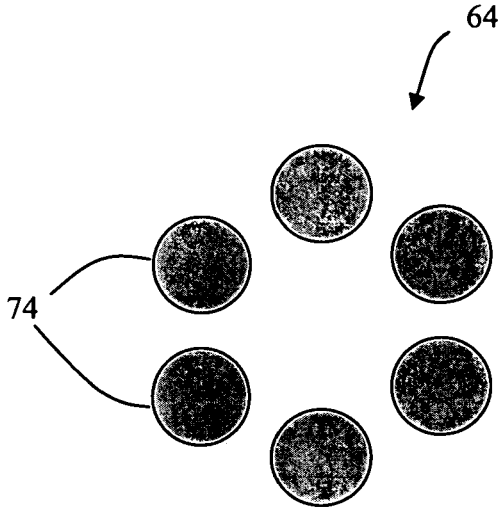
Figure 7:
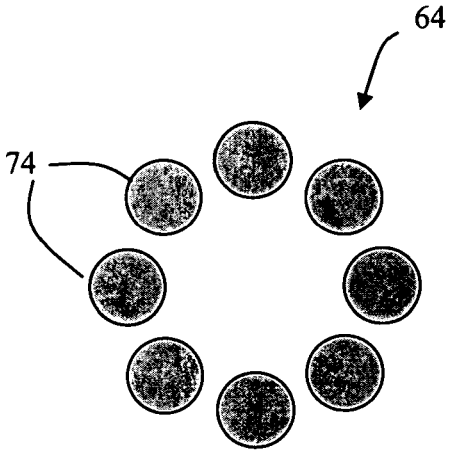

It should be understood that the phrase "a" or "an" used in conjunction with the present teachings with reference to various elements encompasses "one or more" or "at least one" unless the context clearly indicates otherwise. Reference is first made to FIG. 1, which shows schematically a mass spectrometer, generally indicated by reference number 20. The mass spectrometer 20 comprises an ion source 22 for providing ions 30 from a sample of interest, not shown. The ion source 22 can be positioned in a high-pressure P0 region containing a background gas (not shown), generally indicated at 24, while the ions 30 travel towards a vacuum chamber 26, in the direction indicated by the arrow 38. The ions enter the chamber 26 through an inlet aperture 28, where the ions are entrained by a supersonic flow of gas, typically referred to as a supersonic free jet expansion 34 as will be described below. The vacuum chamber 26 further comprises an exit aperture 32 located downstream from the inlet aperture 28 and an ion guide 36 positioned between the apertures 28, 32 for radially confining, focusing and transmitting the ions 30 from the supersonic free gas jet 34. The exit aperture 32 in FIG. 1 is shown as the inter-chamber aperture separating the vacuum chamber 26, also known as the first vacuum chamber 26, from the next or second vacuum chamber 45 that may house additional ion guides or a mass analyzer 44 as will be described below. Typical mass analyzers 44 in the present teachings can include quadrupole mass analyzers, ion trap mass analyzers (including linear ion trap mass analyzer) and time-of-flight mass analyzers. The pressure P1 in the vacuum chamber 26 can be maintained by pump 42, and power supply 40 can be connected to the ion guide 36 to provide RF voltage in a known manner. The ion guide 36 can be a set of quadrupole rods with a predetermined cross-section characterized by an inscribed circle with a diameter as indicated by reference letter D (also shown in FIG. 5), extending along the axial length of the ion guide 36 to define an internal volume 37. The ions 30 can initially pass through an orifice-curtain gas region generally known in the art for performing desolvation and blocking unwanted particulates from entering the vacuum chamber, but for the purpose of clarity, this is not shown in FIG. 1.

Figure 2:
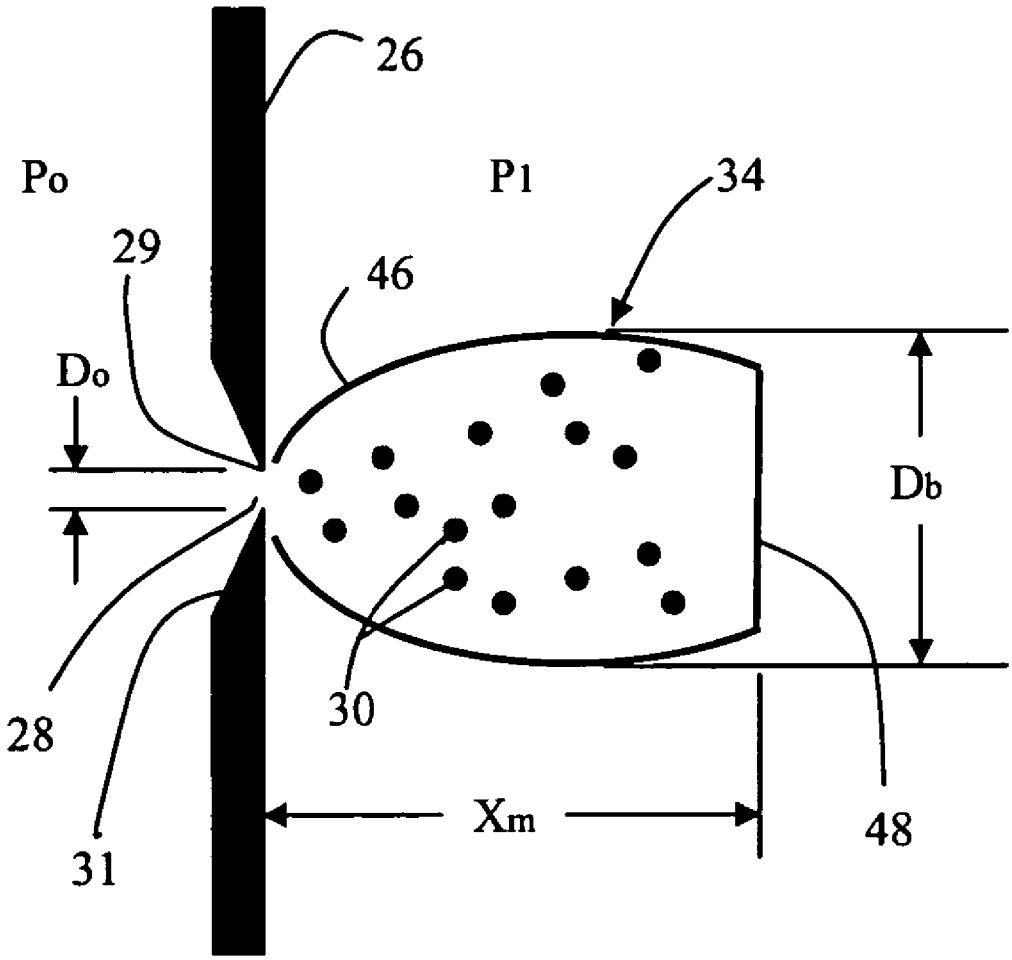
FIG. 2 is a more detailed schematic view of the inlet aperture, the ions and the supersonic free jet expansion according to the present teachings.

To help understand how the ions 30 can be radially confined, focused and transmitted between the inlet and exit apertures 28, 32, reference is now made to FIG. 2. The adiabatic expansion of a gas, from a nominal high-pressure P0 region, into a region of finite background pressure P1, forming an unconfined expansion of a supersonic free gas jet 34 (also known as a supersonic free jet expansion), has been well characterized. The inlet aperture 28 comprises a sonic orifice or a sonic nozzle, where the expansion of the gas through the orifice or nozzle can be divided into two distinct regions based upon the ratio of the flow speed to the local speed of sound. In the high-pressure P0 region, the flow speed near the orifice or the nozzle is lower than the local speed of sound. In this region the flow can be considered subsonic. As the gas expands from the inlet aperture 28 into the background pressure P1 the flow speed increases while the local speed of sound decreases. The boundary where the flow speed is equal to the speed of sound is called the sonic surface. This region is called the supersonic region or more commonly the supersonic free jet expansion, as will be described below. The shape of the aperture influences the shape of the sonic surface. When the aperture 28 can be defined as a thin plate, the sonic surface can be bowed out towards the P1 pressure region. The use of an ideally shaped nozzle, conventionally comprising a converging-diverging duct similar to that shown in FIG. 12, produces a sonic surface that is flat and lies at the exit of the nozzle. The converging portion can also be conveniently defined by the chamfer 31 surface indicated in FIG. 2, while the volume of the vacuum chamber 26 can define the diverging portion. A minimum area location of the converging-diverging duct is often called the throat 29, and in the present teachings, the diameter of the minimum area or throat 29 is Do as shown in FIG. 2. The velocity of the gas passing through the throat 29 becomes "choked" or "limited" and attains the local speed of sound, producing the sonic surface, when the absolute pressure ratio of the gas through the diameter Do is less than or equal to 0.528. In the supersonic free jet 34, the density of the gas decreases monotonically and the enthalpy of the gas from the high-pressure region 24 is converted into directed flow. The gas kinetic temperature drops and the flow speed exceeds that of the local speed of sound (hence the term supersonic expansion). As shown in FIG. 2 the expansion comprises a concentric barrel shock 46 and terminated by a perpendicular shock known as the Mach disc 48. As the ions 30 enter the vacuum chamber 26 through the inlet aperture 28, they are entrained in the supersonic free jet 34 and since the structure of the barrel shock 46 defines the region in which the gas and ions expand, virtually all of the ions 30 that pass through the inlet aperture 28 are confined to the region of the barrel shock 46. It is generally understood that the gas downstream of the Mach disc 48 can re-expand and form a series of one or more subsequent barrel shocks and Mach discs that are less well-defined compared to the primary barrel shock 46 and primary Mach disc 48. The density of ions 30 confined in the subsequent barrel shocks and Mach discs, however, can be correspondingly reduced as compared to the ions 30 entrained in the primary barrel shock 46 and the primary Mach disc 48.

The supersonic free jet expansion 34 can be generally characterized by the barrel shock diameter Db, typically located at the widest part as indicated in FIG. 2, and the downstream position Xm of the Mach disc 48, as measured from the inlet aperture 28, more precisely, from the throat 29 of the inlet aperture 28 producing the sonic surface. The Db and Xm dimensions can be calculated from the size of the inlet aperture, namely the diameter Do, the pressure at the ion source P0 and from the pressure P1 in the vacuum chamber, as described, for example, in the paper by Ashkenas, H., and Sherman, F. S., in deLeeuw, J. H., Editor of Rarefied Gas Dynamics, Fourth Symposium IV, volume 2, Academic Press, New York, 1966, p. 84:

$$Db=0.412\times Do\times\sqrt{(P0/P1)} \quad (1)$$

$$Xm=0.67\times Do\times\sqrt{(P0/P1)} \quad (2)$$

where P0 is the pressure around the ion source 22 region 24 upstream of the inlet aperture 28 and P1 is the pressure downstream of the aperture 28 as described above. For example, if the diameter of the inlet aperture 28 is approximately 0.6 mm, with a suitable pumping speed so that the pressure in the downstream vacuum chamber 26 is about 2.6 torr, and the pressure in the region of the ion source 22 is about 760 torr (atmosphere), then from equation (1), the predetermined diameter of the barrel shock Db is 4.2 mm with a Mach disc 48 located at approximately 7 mm downstream from the throat 29 of the inlet aperture 28, as calculated from equation (2).

Figure 3:
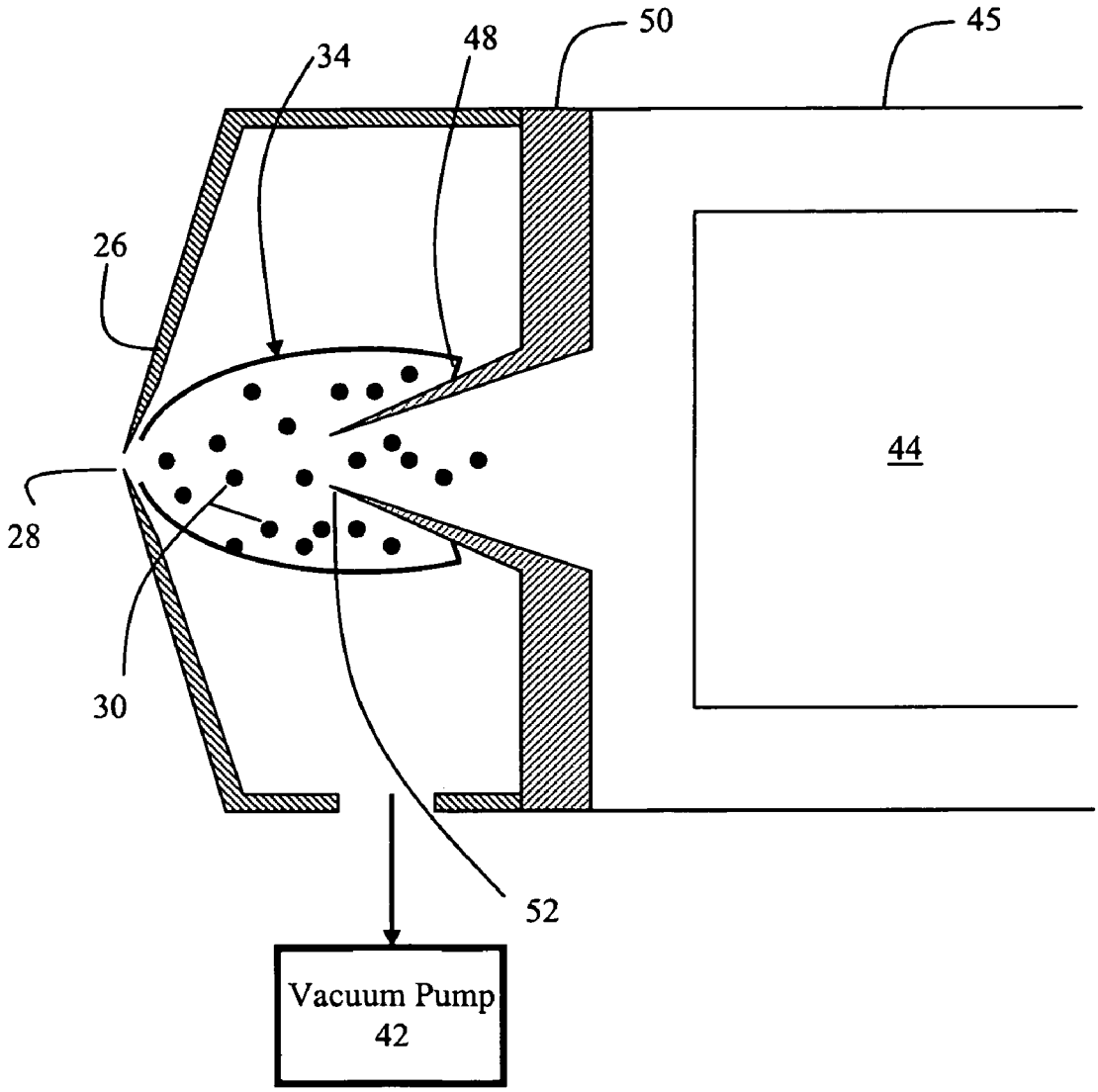
FIG. 3 is a schematic view of a prior art aperture and skimmer configuration.

One of the most common prior-art methods of sampling the ions from the supersonic free jet 34 into the second vacuum chamber 45, which contains the mass analyzer 44, is through a skimmer 50 as indicated in FIG. 3. The tip 52 of the skimmer 50 can be positioned upstream or downstream of the Mach disc 48, at zones characterized by having distinct gas densities well known in fluid mechanics, to sample and pass ions 30 to the mass analyzer 44. In FIG. 3, the skimmer 50 samples the ions axially upstream of the Mach disc 48, while others have positioned the skimmer orthogonal to the supersonic free jet 34 and downstream of the Mach disc 48. In FIG. 3, a portion of the Mach disc 48 is indicated, but as generally known in fluid mechanics, the barrel shock can be attached to the skimmer, thus resulting in a modified profile from that which is shown. Whether positioned upstream or downstream of the Mach disc 48, the skimmer configurations of the prior art only sample a portion of the available ions 30 from the supersonic free jet expansion 34. Although not shown, it is common to apply a static electric field (electrostatic) between the inlet aperture 28 and the skimmer tip 52 to try to draw as many ions as possible towards the skimmer 50. The skimmer tip 52, however, needs to be maintained at a relatively small diameter in order to keep the pressure in the next chamber 45 as low as required for the mass analyzer 44 to function properly. This means that, even with the application of an electric field, not all of the ions 30 can be sampled through the skimmer 50, which reduces the sensitivity capability of the mass spectrometer. If the diameter of the inlet aperture 28 is increased in order to pass more ions 30 from the ion source 22, then the pressure within the supersonic free jet 34 is increased, making it more difficult to focus the ions 30 electrostatically.

All of these factors make it difficult to increase the sensitivity in the prior-art inlet aperture-skimmer configuration sampling system simply by increasing the inlet aperture diameter. While successful up to a point, expanding the diameter of the inlet aperture (with a concomitant increase in the size of the vacuum pumps to maintain the vacuum chamber pressures at the required low pressure) is not a practical solution, as eventually the cost and size of the vacuum pumps becomes too large to be commercially successful.

In all of the above prior art configurations, the ions to be analyzed require focusing for passage through an entrance fringing field region between the inlet aperture 28 and the ion guide 36, thus requiring electrostatic focusing means within a region where the pressure or density is relatively large, leading to potential losses in sensitivity. Furthermore, if the ions require passage through another limiting aperture, such as the skimmer, before entering the ion guide, then there are likely to be losses before reaching the ion guide, resulting in further reduced sensitivity.

The applicants recognize that the supersonic free jet expansion 34 and barrel shock structure 46 expanding downstream from the throat 29 of the inlet aperture 28 can be an effective method of transporting the ions 30 and confining their initial expansion until the ions 30 are well within the volume 37 of the ion guide 36. The fact that all of the gas and ions 30 are confined to the region of the supersonic free jet 34, within and around the barrel shock 46, means that a large proportion of the ions 30 can be initially confined to the volume 37 of the ion guide 36 if the ion guide 36 is designed to accept the entire or nearly the entire free jet expansion 34. Additionally, the applicants recognize that the ion guide 36 can be positioned at a location so that the Mach disc 48 can be within the volume 37 of the ion guide 36. By locating the ion guide 36 downstream of the inlet aperture 28, and in a position to include essentially all of the diameter Db of the free jet expansion 34, a larger inlet aperture 28 can be used and thus a higher vacuum chamber 26 pressure P1 can be used while maintaining high efficiency in radially confining and focusing the ions 30 between the apertures 28, 32 thereby to allow more ions into the second vacuum chamber 45. Accordingly, with the appropriate RF voltage, ion guide dimensions and vacuum pressure, not only can the ion guide 36 provide radial ion confinement, but the ion guide 36 can also focus the ions 30 while the ions 30 traverse the internal volume between the inlet 28 and exit 32 apertures, as described, for example, in U.S. Pat. No. 4,963,736 (the '736 patent) by Douglas and French, the contents of which are incorporated herein by reference. In the present teachings, although the function of the ion guide 36 can be described to provide both radial confinement and focusing of the ions, it is not essential that the ion guide 36 perform the ion focusing effect. Greater efficient ion transmission between the inlet and exit apertures 28, 32, however, can be achieved with the focusing capabilities of the ion guide 36.

Figure 4:
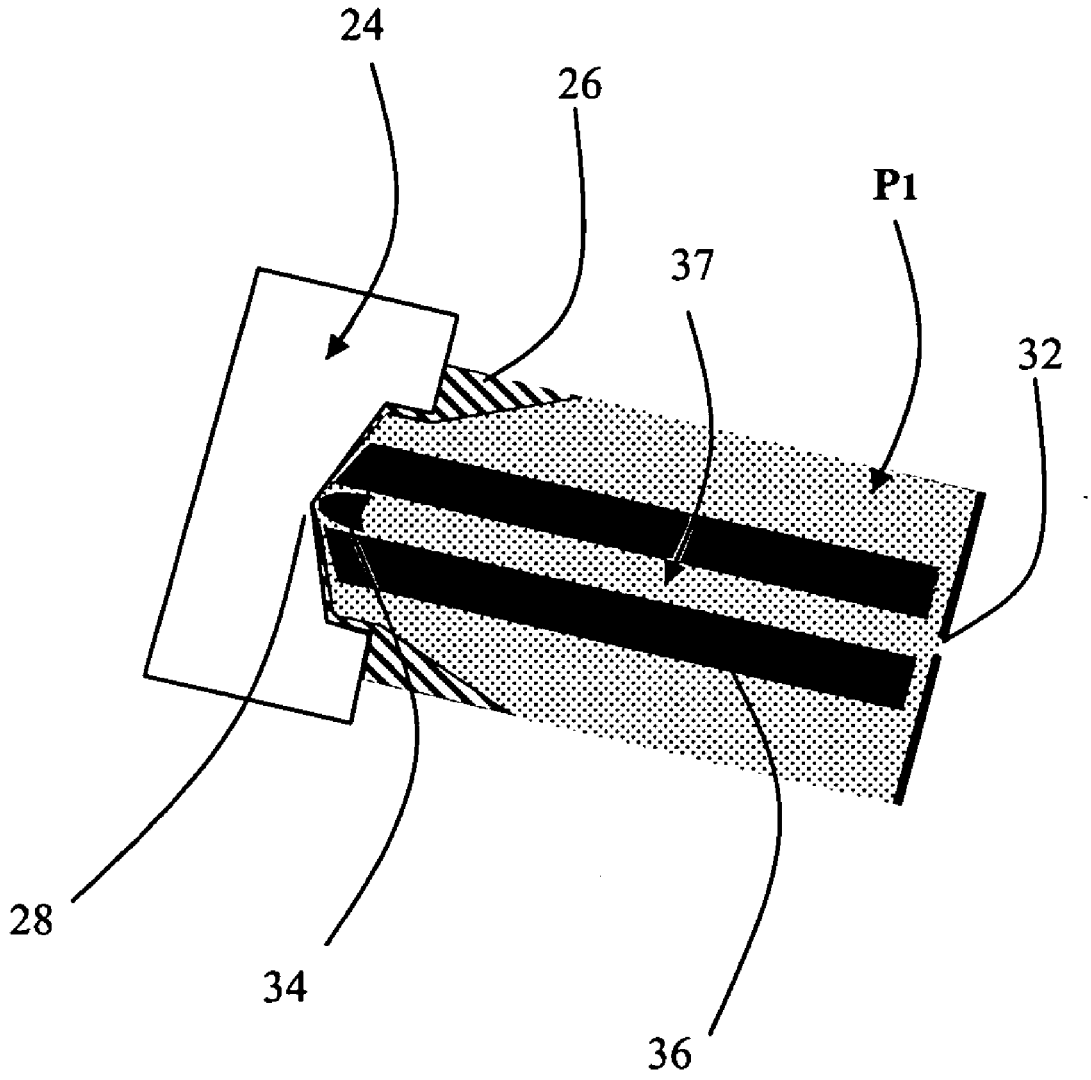
FIG. 4 is a graphical representation of a computational simulation of the embodiment of FIG. 1.

In the example described above, where the barrel shock 46 diameter Db is approximately 4.2 mm and the position Xm of the Mach disc 48, measured from the throat of the inlet aperture 28, is about 7 mm, the predetermined cross-section of the ion guide 36 (in this instance, an inscribed circle of diameter D) can be about 4 mm in order for all or essentially all of the confined ions 30 in the supersonic free gas jet 34 to be contained within the volume 37 of the ion guide 36. An appropriate length for the ion guide 36 greater than 7 mm can be chosen so that effective RF ion radial confinement can be achieved. This results in maximum sensitivity without the necessity of increasing the vacuum pumping capacity and thus the cost associated with larger pumps. A graphical representation of these results from computational simulation showing how the supersonic free jet expansion 34 can be confined within the volume 37 of the ion guide 36 is shown in FIG. 4. The reference numbers in FIG. 4 are the same as the reference numbers indicated in FIG. 1.

As described above and in accordance with equations (1) and (2), the pressure P1 within the vacuum chamber 26 containing the ion guide 36 contributes to the characterization of the supersonic free jet 34 structure. If the pressure P1 is too low, then the diameter Db of the barrel shock 46 is large, and the ion guide 36 can require substantial practical efforts to be large enough to confine the ions 30 entrained by the supersonic free jet expansion 34. Consequently, if a large inscribed diameter D can be sized accordingly to a large barrel shock diameter Db, then larger voltages must be used in order to provide effective ion radial confinement and ion focusing. However, larger voltages can cause electrical breakdown and discharge, which can interfere with proper function of the ion guide and can introduce considerable complexity to the instrument for safe and reliable operation. Additionally, power supplies capable of providing large voltages tend to be priced high, which can drive up the cost of commercial instruments. Therefore, it is most effective to keep the pressure relatively high so as to keep the jet diameter small and to keep the diameter D of the ion guide as small as possible so that voltages are maintained below electrical breakdown.

Conversely, if the pressure P1 is too high, then the focusing action of the ion guide 36 is reduced. Consequently, the applicants have determined, through computational simulations of ion motion that fast and effective focusing action can be obtained at a pressure between about 1 and 10 torr. In this range the supersonic free jet's diameter Db is small for typical diameters of the aperture of about 0.4 and 1 mm, and the ion guide diameter can be practically applied. Specifically, the inscribed diameter D can be between about 2 and 8 mm. Effective confinement can be obtained with RF voltages of between about 50 and 300 Volts peak to peak, limited at the upper end only by the requirement not to exceed the breakdown voltage of the gas at the operating pressure. Typical RF frequencies can be between about 1 and 2 MHz, although other frequencies of between about 0.5 and 5 MHz can also be quite practical and effective.

Figure 11:
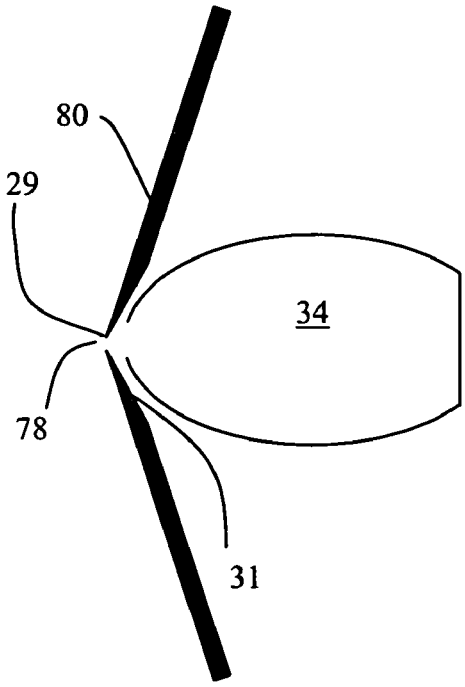
FIGS. 11 & 12 are schematic cross-section views of various embodiments of the inlet aperture according to the present teachings.
Figure 12:
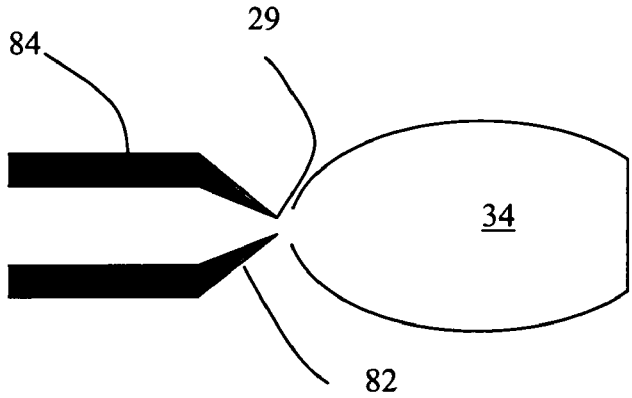

While the present teachings are described in conjunction with various embodiments, it is not intended that the present teachings be limited to such embodiments. On the contrary, the present teachings encompass various alternatives, modifications, and equivalents, as will be appreciated by those of skill in the art. For example, the present applicants recognize that the throat 29 of the inlet aperture 28 can have a finite length, and while it is desirable for the length to be as short as possible for certain applications while maintaining structural integrity, apertures with long throat lengths, such as a capillary, can also provide a free jet expansion at the end of the capillary. In various embodiments, the inlet aperture 28 of FIG. 1 can be a sonic orifice 78 at the tip of a cone 80 as shown in FIG. 11, where the chamfer 31 is on the P1 (lower) pressure side, or the inlet aperture can be a converging nozzle 82 at the end of a tube 84 as shown in FIG. 12. In either example, the configuration of the aperture can be described as follows. At specific pressure differences (between P0 and P1), the gas passing through the throat 29 is characterized as having choked flow or, more accurately "choked velocity", where the velocity of the gas is sonic. This occurs for airflow when the downstream absolute pressure P1 is about 52.8% of the upstream absolute pressure P0. In FIGS. 2, 11, 12, the throat 29 comprises the diameter Do adjacent to the vacuum pressure P1. Upstream and adjacent to the diameter Do, the gas accelerates towards sonic velocity and tends to entrain or drag the ions 30 and transmits them through the aperture 28 with high efficiency. When the length of the throat 29 is long, such as a capillary, the gas velocity at the entrance to the throat is subsonic and the gas drag into the entrance of the throat is reduced. The effects of a short throat length, therefore, can be used to further achieve optimum ion transmission from the high pressure region 24 into the vacuum chamber 26.

While the parameters used in the calculations above can provide improvements, as will be described in the example below, it can also be practical to use other combinations of inlet aperture diameter and pressure P1 for the present teachings. For example, in various embodiments, with an inlet aperture 28 diameter Do of about 0.1 mm and pressure P1 of about 0.1 torr, the predetermined diameter Db of the barrel shock 46 is calculated to be 3.6 mm. An ion guide 36 of approximately 4 mm diameter D would effectively capture the supersonic free jet 34 and radially confine the ions 30. Similarly, an inlet aperture 28 diameter Do of about 0.2 mm and a pressure P1 of about 10 torr would result in a predetermined diameter Db of 1.2 mm, so that a small ion guide 36 of approximately 1.2 mm diameter D, requiring therefore lower RF voltages, can be used. Furthermore, it can be understood that the configuration of the inlet aperture 28 of the present teachings, can conceivable be non-circular in its cross-section. For example, in various embodiments, the inlet aperture 28 can be square or triangular having a cross-sectional area that can be equivalent to a corresponding circular cross-section area with diameter Do.

The predetermined cross-section of the ion guide 36 can be sized less than the predetermined diameter Db to be able to confine a corresponding portion of the ions in the supersonic free jet 34 while still achieving a significant improvement in sensitivity. For example, in various embodiments, the cross-section of the ion guide 36 can be sized so that the cross-section is at least 50% of the predetermined diameter Db.

Although the ion guide 36 of FIG. 1 is positioned so that the internal volume 37 envelops the supersonic free jet expansion 34 entirely along the linear axis, the applicants have contemplated the placement of the ion guide 36 downstream of the inlet aperture 28 such that the volume 37 of the ion guide 36 envelops some or none of the primary barrel shock 46 and the primary Mach disc 48. It can be appreciated that such a downstream placement of the ion guide 36 internal volume 37 to envelop none or part of the primary barrel shock 46 and the primary Mach disc 48 of FIGS. 1 and 2 can still envelop the subsequent re-expanded barrel shocks and Mach discs.

Figure 13:
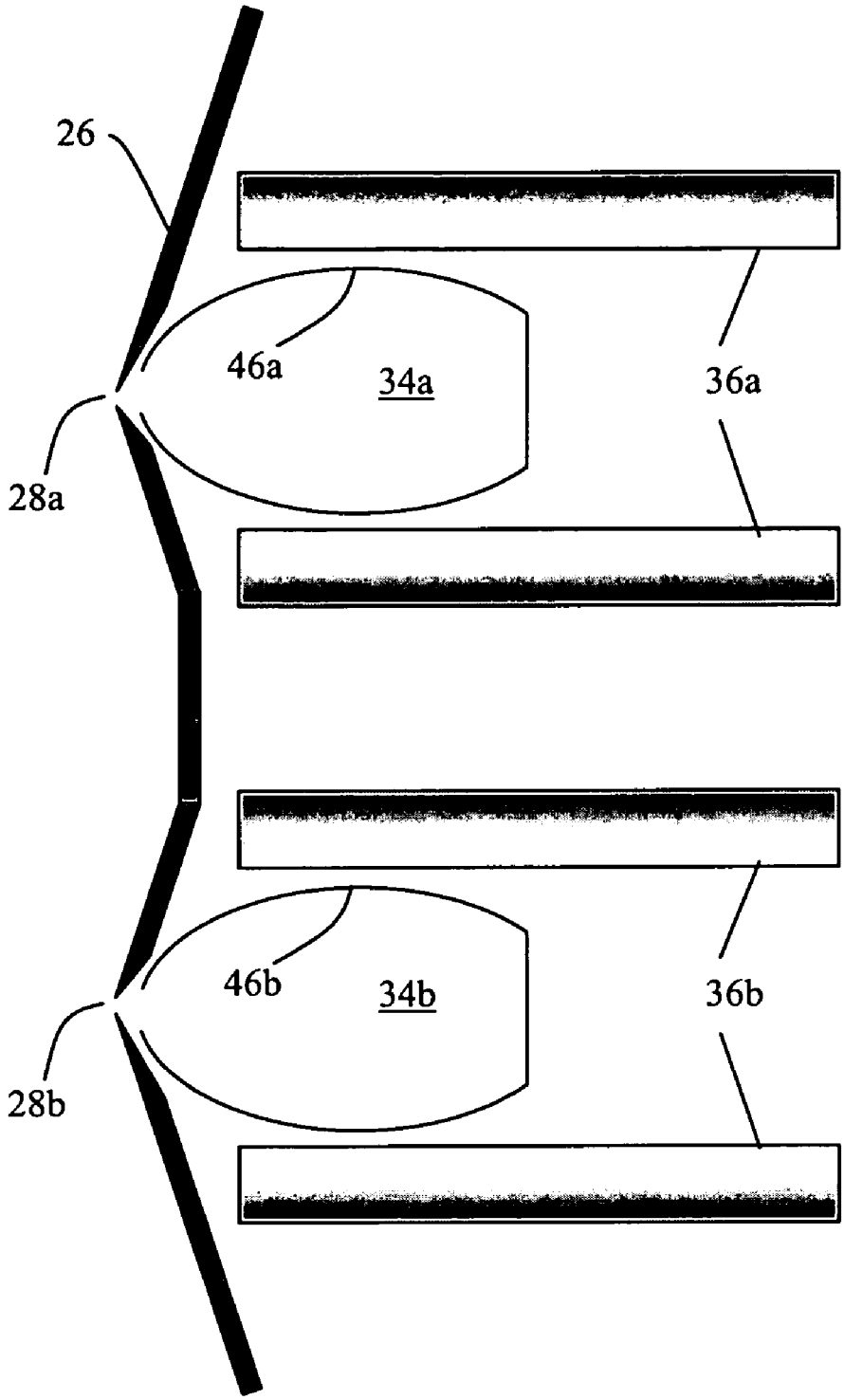
FIG. 13 is a schematic view of various embodiments of the present teachings.
Figure 14:
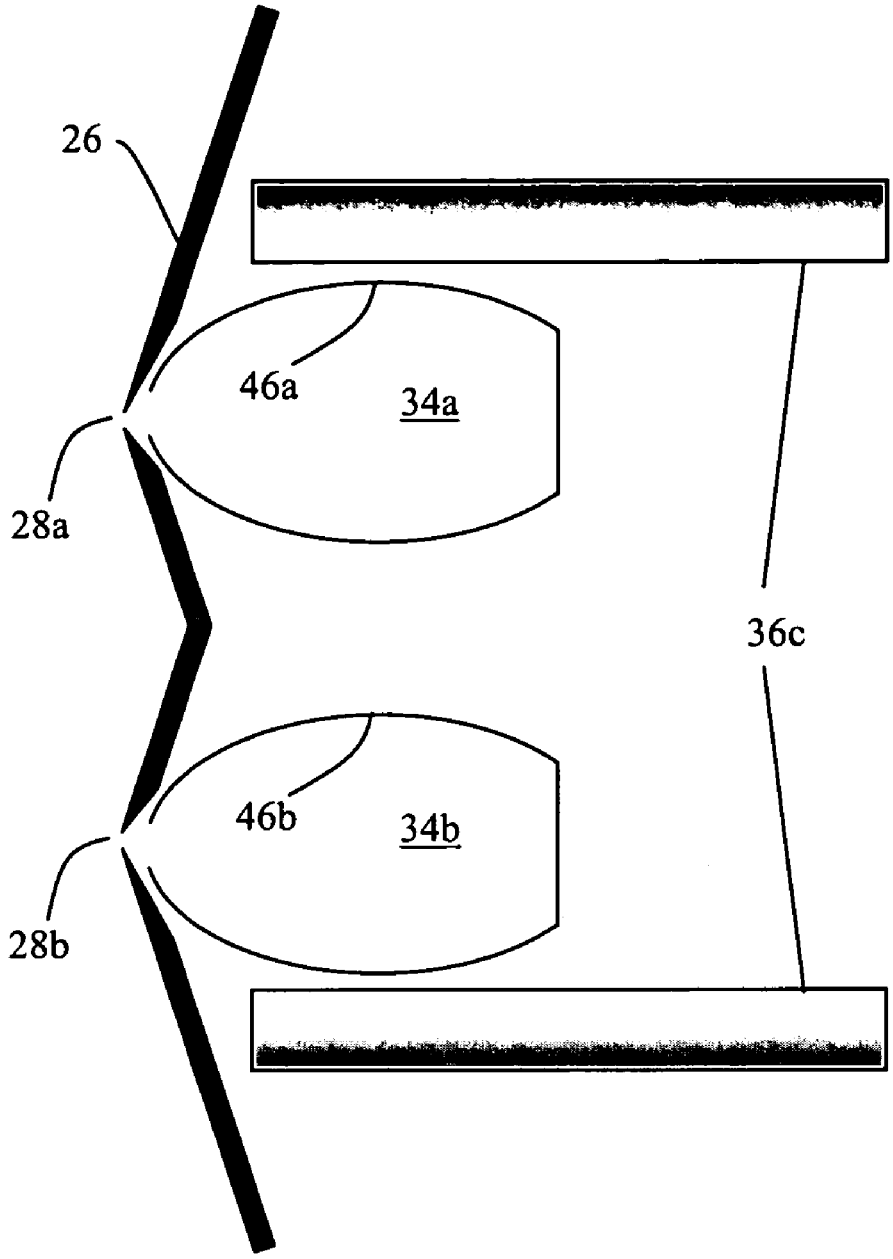
FIG. 14 is a schematic view of various embodiment of the present teachings.

The applicants have contemplated the use of one or more inlet apertures 28 for achieving substantially the same ion transmission efficiency. For example, in various embodiments, two apertures 28*a*, 28*b* are shown in FIG. 13, but it is understood by those skilled in the art that additional apertures and their corresponding elements, as described next, are implicitly implied subject to practicality. The same numbering system has been used to denote common elements as those shown in FIG. 1 except with the addition of the letters "a" and "b". Each of the apertures 28*a*, 28*b* can form corresponding supersonic free jet expansions 34*a*, 34*b* and barrel shocks 46*a*, 46*b*, and at least one of the free jets 34*a*, 34*b* being enveloped by their corresponding ion guides 36*a*, 36*b*. The accumulative cross-sectional area of the inlet apertures 28*a*, 28*b* can be equal to the cross-sectional area of a single inlet aperture 28 having the desired diameter as described above. The ions which are radially confined and transmitted by the one or more of the ion guides 36*a*, 36*b* can be further confined and focused and transmitted by an additional ion guide to combine the ions together into a single ion beam, not shown. It is also contemplated that the array of supersonic free jets 34*a*, 34*b*, either discrete or overlapping jets, can be enveloped by one ion guide 36*c*, where the inscribed diameter D of ion guide 36*c* is appropriately sized, as shown in FIG. 14.

Figure 8:
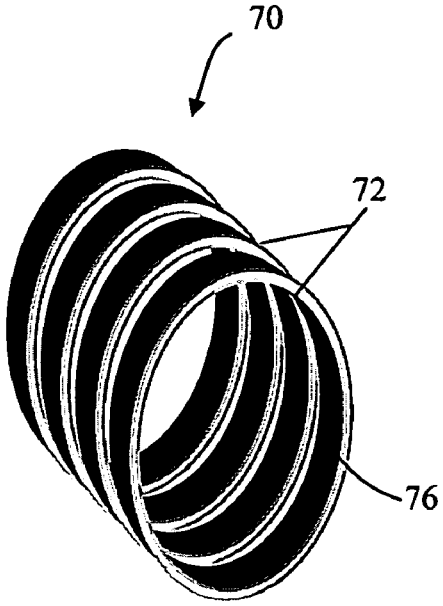
Figure 9:
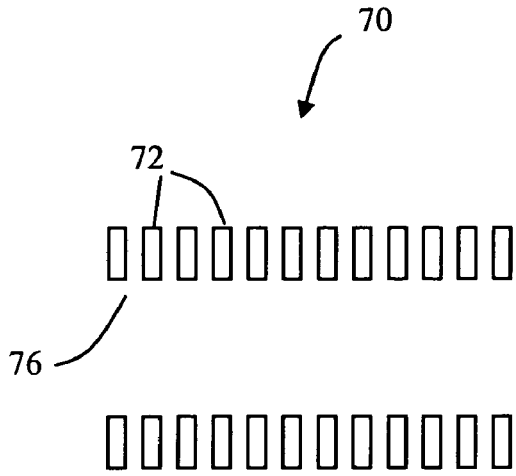
Figure 10:
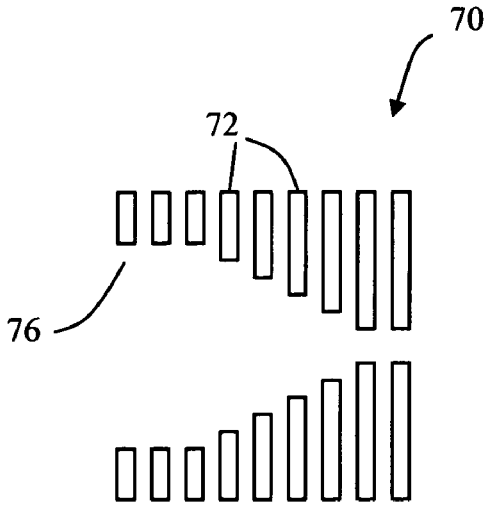

The ion guide 36 acting as ion confinement, focusing and guiding devices can be of the type indicated in FIGS. 5 to 10. The multipole ion guide of FIGS. 5, 6 and 7 can include the quadrupole (4 poles) 64, hexapole (6 poles) 66 and octapole (8 poles) 68 or higher number of poles 74. The poles 74 are elongated electrodes carrying the RF voltages generally known in the art. Other configurations containing greater numbers of poles, or electrodes of different shapes, are also possible. For example, the electrodes can consist of wires or rods and can be square instead of circular in cross section, or the electrodes can have cross sections that vary along the elongated length. In various embodiments, the poles 74 can be multiple electrode segments connected to corresponding power supplies to provide differential fields between adjacent segments. The ion guides of FIGS. 8, 9 and 10 are typically known as a ring ion guide 70 where individual rings or plates 72 with holes 76 are generally aligned with respect to each other to form an axial passage for the ions 30 to traverse. The adjacent plates 72 can carry opposite phases of the RF voltage as generally known in the art. The stacked plates 72 of FIG. 9 have substantially similar diameter holes 76 while the plates 72 of FIG. 10 vary in hole diameters so to provide a converging or focusing action. A combination of converging and diverging effect can be applicable either with the stacked plates 72 or with the elongated electrodes with varied cross section. Any RF focusing device which confines the ions 30 by means of inhomogeneous (in space) alternating electric fields can be used. In various embodiments, a quadrupole ion guide can be used to provide focusing action that is stronger toward the center of the device, and the ions can be more strongly confined to a narrow position near the axis. This can be advantageous for transmitting ions 30 through a small exit aperture 32 into the next chamber 45.

Figure 16:
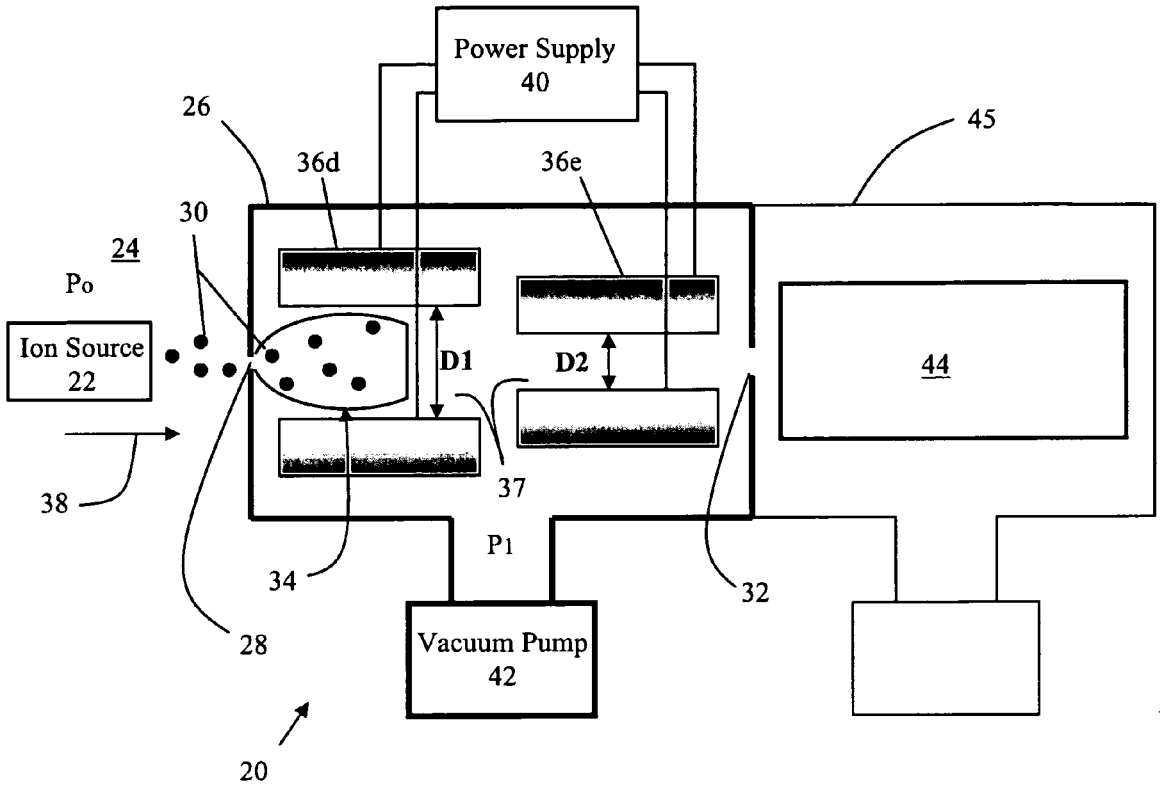
FIGS. 16 & 17 are schematic views of various embodiments of the present teachings.
Figure 17:
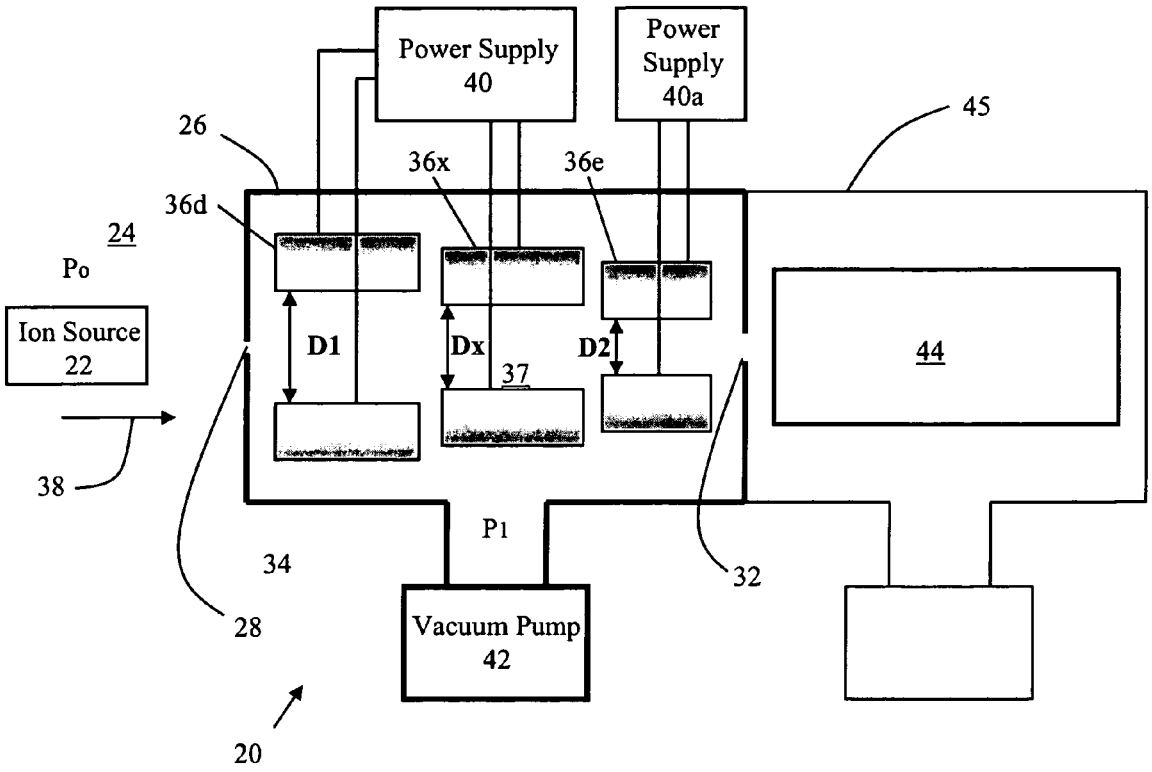

Further embodiments are exemplified in FIGS. 16 and 17, in which common elements have the same reference numerals as in FIG. 1 and some common elements have been omitted to provide clarity of the figure. In FIG. 16, the ion guide 36 of FIG. 1 is replaced by a series of ion guides 36*d* and 36*e*. In this example, the two ion guides 36*d* and 36*e* define the series, however, as will be discussed below, the series of ion guides can comprise more than two ion guides. Each ion guide 36*d* and 36*e* can be characterized by having predetermined cross-sections with inscribed diameters D1 and D2. The diameters D1 and D2 respectively extend along the axial length of each ion guide 36*d* and 36*e* to define internal volumes which are collectively represented by the reference number 37. As indicated in FIG. 16, the diameters D1 and D2 are dissimilar and power supply 40 can have independent connections to ion guides 36*d* and 36*e* for radially confining the ions within the internal volumes 37 of the ion guides, as will be discussed below.

The configuration according to FIG. 1 comprising the ion guide 36 with a single RF confinement field may not be optimal for providing ion transfer between the inlet and exit apertures 28, 32 in certain applications. For example, a set of operating parameters defined by the applied RF voltage, the ion guide dimension such as the inscribed diameter D, and the vacuum pressure P1 can be chosen to provide optimum ion focusing and ion transmission to the exit aperture 32. These same parameters, however, may be sufficient to envelop only a portion of the predetermined diameter Db of the barrel shock and thus the optimum acceptance of the ions' 30 initial expansion may not be realized. The converse is also possible where another set of parameters chosen for the optimum ion acceptance condition may not provide optimum ion focusing and transmission to the exit aperture 32. Accordingly, the applicants have determined that it can be an advantage in certain applications to achieve optimization between ion focusing/transmission and ion acceptance by providing separate radial RF confinement fields, one field for accepting and confining the ions 30 emerging from the inlet aperture 28 within the volume 37, and another field for focusing the ions 30 to pass from the volume 37 to the exit aperture 32.

The foregoing optimization can be accomplished by, as shown in FIG. 16, applying to the first ion guide 36*d* a corresponding RF voltage for establishing a RF confinement field that is optimized for accepting the ions' 30 initial expansion and applying to the second ion guide 36*e* a corresponding RF voltage for establishing an RF confinement field for focusing the ions 30 to the dimensions of the exit aperture 32. In various embodiments, the first ion guide 36*d*, nearest to the ion source and consequently nearest to the inlet aperture 28, can be configured for having an inscribed diameter D1 sized accordingly to accept at least 50% of the barrel shock diameter Db such that all or essentially all of the confined ions 30 in the supersonic free gas jet 34 can be enveloped within the volume 37 of the ion guide 36*d*. The corresponding RF voltage applied to the first ion guide 36*d* can be selected according to, in addition to the ions' 30 mass of interest, the diameter D1 and pressure P1 for effectively confining and focusing of the enveloped ions 30 to allow efficient transmission into ion guide 36*e*, while not exceeding the breakdown voltage of the gas at the operating pressure.

Furthermore, the ion guide 36*e* nearest to the exit aperture 32 can be configured with a cross-section to have an inscribed diameter D2 according to the dimensions of the exit aperture 32. The corresponding RF voltage applied to the ion guide 36*e* can be selected according to the diameter D2 for establishing an RF confinement field within volume 37 of the ion guide 36*e* to focus all or essentially all of the ions 30 to the dimensions of the exit aperture 32. The dimensions of the exit aperture can be defined, for example, by its diameter as in the case for a circular aperture, or by another dimensional parameter for other geometric configurations, such as the aperture's width as in the case for a square aperture. Regardless of the specific geometric shape, the cross-sectional area of the exit aperture 32 can be generally described by an equivalent circular cross-sectional area defined by a diameter. Optimum ion transmission can be realized when the ions 30 are focused to form an ion beam with a diameter that is equal to or less than the diameter of the exit aperture 32. While sufficient ion transmission can be achieved when the ion beam diameter is greater than the exit aperture 32 diameter, it will be apparent to those skilled in the art that optimum ion transmission focusing can be expected when the beam diameter is less than or equal to the diameter of the exit aperture 32.

Generally, the function of the first ion guide 36*d* is for capturing and focusing the ions 30 from the inlet aperture 28 while the function of the second ion guide 36*e* is for focusing and transmitting the ions 30 from the first ion guide 36*d* to the exit aperture 32. The first ion guide 36*d* diameter D1 and the corresponding applied RF voltage are chosen according to the predetermined diameter Db of the barrel shock while the second ion guide 36*e* diameter D2 and the corresponding applied RF voltage are chosen according to the diameter of the exit aperture 32 as discussed above. In various embodiments, the diameter Db of the barrel shock can often be larger than the diameter of the exit aperture 32, thus the corresponding cross-section of the first ion guide 36*d* can be greater than the corresponding cross-section of the second ion guide 36*e*. Consequently, in various embodiments for optimum ion transmission between the inlet 28 and the exit 32 apertures, the relative ratio of the cross-sections of the second to first ion guides 36*e*, 36*d* can be less than 1. Typically, as in Example 2 described below, the applicants have utilized a diameter D2 of about 4 mm and a diameter D1 of about 7 mm to give a relative ratio between the cross-sections of the ion guides of about 0.6 to show improved ion 30 transmission between the inlet and exit apertures 28, 32. In various embodiments, the cross-sections of the first and second ion guides 36*d*, 36*e* can be equal while the corresponding RF voltages can be selected to provide RF confinement fields that are independently optimized for ion focusing/transmission and ion acceptance.

In various embodiments, a series of ion guides comprising more than two ion guides is provided for additional multiple focusing stages. For example, in FIG. 17 an additional ion guide 36*x* is disposed between the first ion guide 36*d* and the second ion guide 36*e*. The additional ion guide 36*x* can be configured with corresponding cross-section with internal diameter Dx that is intermediate or equal to the diameters of the first and second ion guides 36*d*, 36*e*. The details of the corresponding RF voltages applied to the first and second ion guides 36*d* and 36*e* are as described above while the corresponding RF voltage applied to the ion guide 36*x* can be configured to provide the same or different radial confinement fields. It will be apparent to those skilled in the art that each corresponding RF voltage can be provided by two or more independent power supplies 40 and 40*a* or that a single power supply, as shown in FIGS. 16 and 17, can be configured appropriately to deliver independent corresponding RF voltages.

Figure 18:
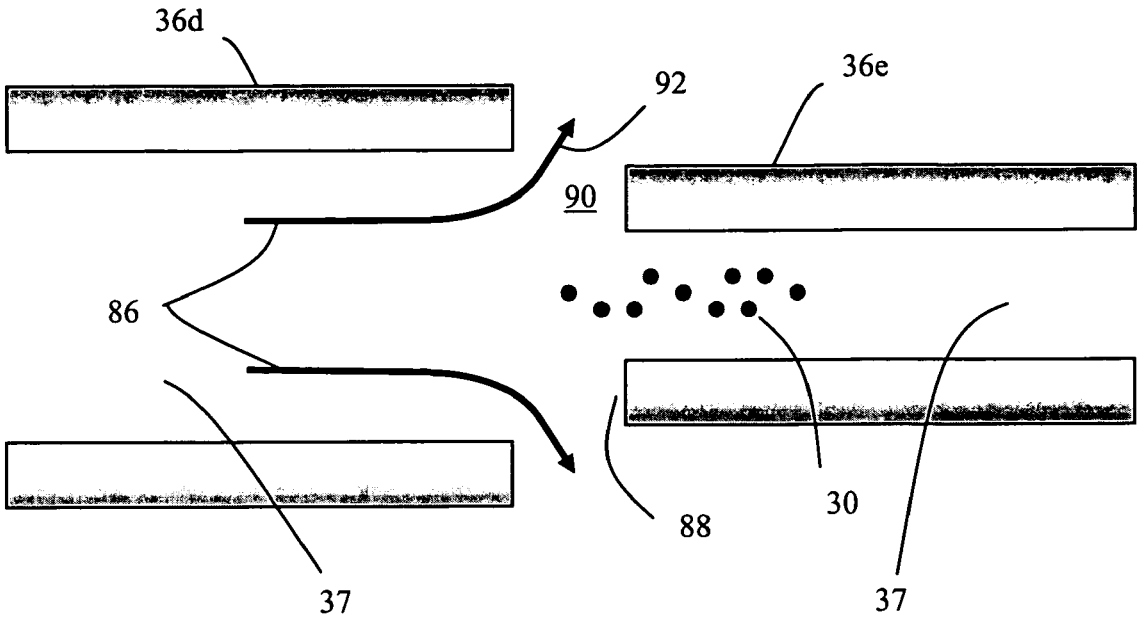
FIG. 18 is a more detailed schematic view of the series of ion guides, the gas flow and the ion transmission according to the present teachings.

It is anticipated that the length of each ion guide 36*d*, 36*x*, 36*e* in the series, can be appropriately selected according to the distance necessary for the corresponding radial RF field to sufficiently focus the ions 30 within the volumes 37. In addition to the focusing function of the ion guides, the ion guides can perform a physical function to limit the amount of gas that is transferred between the inlet aperture 28 and the exit aperture 32. Referring to FIG. 18, the gas streamlines 86 can be a representation of the gas emerging from the supersonic free jet expansion 34 passing through the first ion guide 36*d*. As the ions 30 converge between the first ion guide 36*d* and the second ion guide 36*e*, the gas 86 can encounter the end surface 88 of the second ion guide 36*e* and be diverted away from the path of the ions 30. The diverted gas 86 can pass through a gap 90 between the ion guides 36*d*, 36*e* as indicated by the arrows 92. This can result in an improvement in the ion 30 to gas 86 ratio transmitted through the exit aperture 32 to the mass analyzer 44.

In addition, the shape and size of the ion guides can have an effect on the gas flow characteristics. For example, in various embodiments, increasing the pole diameter of the multipole ion guide can lead to entraining more of the gas flow along the length of the ion guide. The increased pole diameter, while maintaining the diameter D1, effectively increases the radial distance between the center axis 100 to the gap between adjacent poles. This can increase the potential of entraining more of the gas flow in the first ion guide. Alternatively, the shape of the multipoles can be plate-like to increase the surface area of the poles while maintaining or reducing the gap dimension to achieve better gas entrainment.

Figure 19:
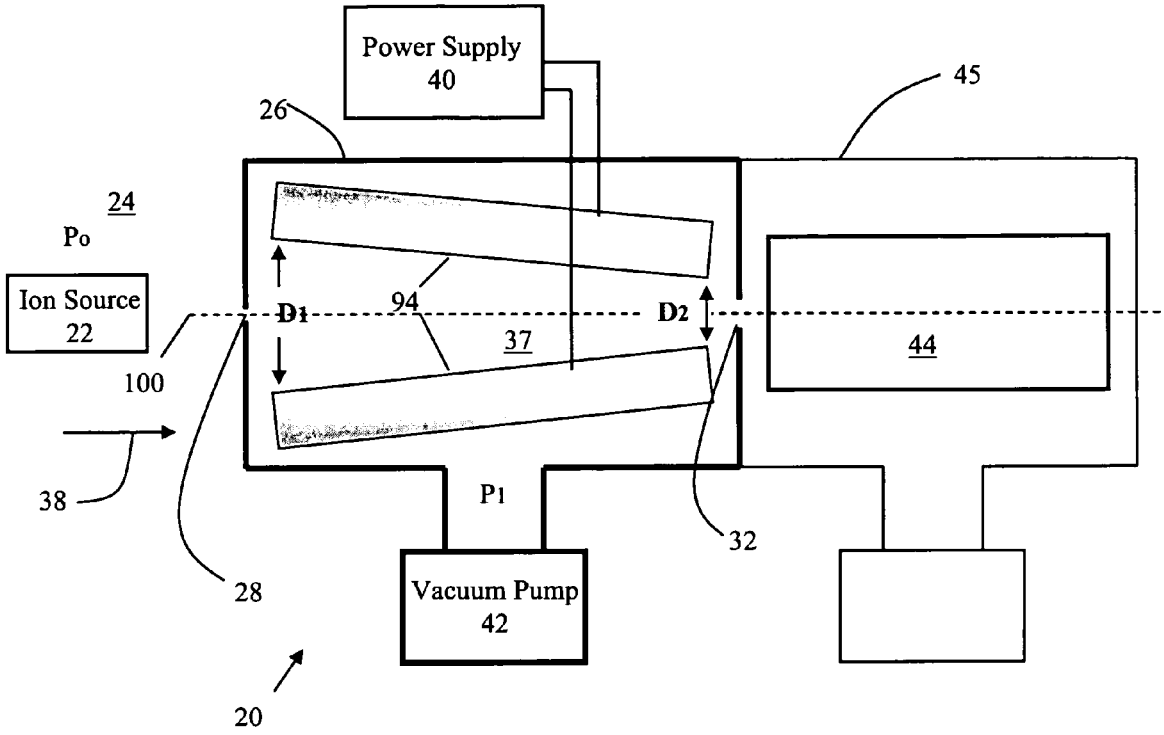
FIG. 19 is a schematic view of various embodiments of the present teachings.

In various embodiments, the single ion guide 94 shown in FIG. 19 can be configured to have an entrance cross-section, characterized by diameter D1 nearest to the ion source that is greater than an exit cross-section, characterized by diameter D2 nearest to the exit aperture 32. For brevity, common elements have the same reference numerals as in FIG. 1 while some elements have been omitted to provide clarity of the figure. The single RF voltage applied to the ion guide 94 can provide a RF confinement field which, when measured along the center axis 100, can increase in strength between the entrance and exit diameters D1, D2. As previously described, the RF voltage is chosen according to the ions' 30 mass of interest and limited at the upper end only by the requirement not to exceed the breakdown voltage of the gas at the operating pressure. The relative ratio of the exit cross-section to the entrance cross-section can be less than 1. Typically, the ratio can be about 0.4 over an ion guide 94 length of between 2 and 20 cm. It will be apparent to those skilled in the art that greater lengths are possible only limited to the space available between inlet and exit apertures 28, 32.

In various embodiments, the second vacuum chamber 45 can have an outlet aperture for passing ions from the second vacuum chamber 45 to the mass analyzer 44, where the mass analyzer 44 can be housed in a third vacuum chamber. The second vacuum chamber 45 can have an RF-only ion guide for radially confining, focusing and transporting the ions 30, as described in the '736 patent, between the exit aperture 32 and the outlet aperture. The exit aperture 32 functions as an inter-chamber aperture 32, as previously described. The RF-only ion guide can be constructed similarly as the ion guide 36. In use, the ions 30 pass from the first vacuum chamber 26 through the inter-chamber aperture 32 into the second vacuum chamber 45 where the ions 30 can be radially confined and focused by the RF-ion guide as the ions 30 traverse the RF-only ion guide. After the ions 30 pass from the second vacuum chamber 45, by way of the outlet aperture, into the third vacuum chamber, the mass analyzer 44 receives the ions 30 for mass analysis. The same power supply 40 which provides RF voltage to the ion guide 36 or a separate power supply can be connected to the RF-only ion guide for providing RF voltage in a known manner.

The ion source 22 can be one of the many known types of ion sources depending of the type of sample to be analyzed. In various embodiments, the ion source 22 can be an electrospray or ion spray device, a corona discharge needle, a plasma ion source, an electron impact or chemical ionization source, a photo ionization source, a MALDI source or any combination thereof. Other desired types of ion sources known to the skilled person in the art may be used, and the ion source can create ions at atmospheric pressure, above atmospheric pressure, near atmospheric pressure, or less than atmospheric pressure, but higher than the pressure associated with the pressure in the vacuum chamber 26 so that the absolute pressure ratio P1/P0≦0.528.

Aspects of the present teachings may be further understood in light of the following examples, which should not be construed as limiting the scope of the present teachings in any way.

EXAMPLES

Example 1

Figure 15:
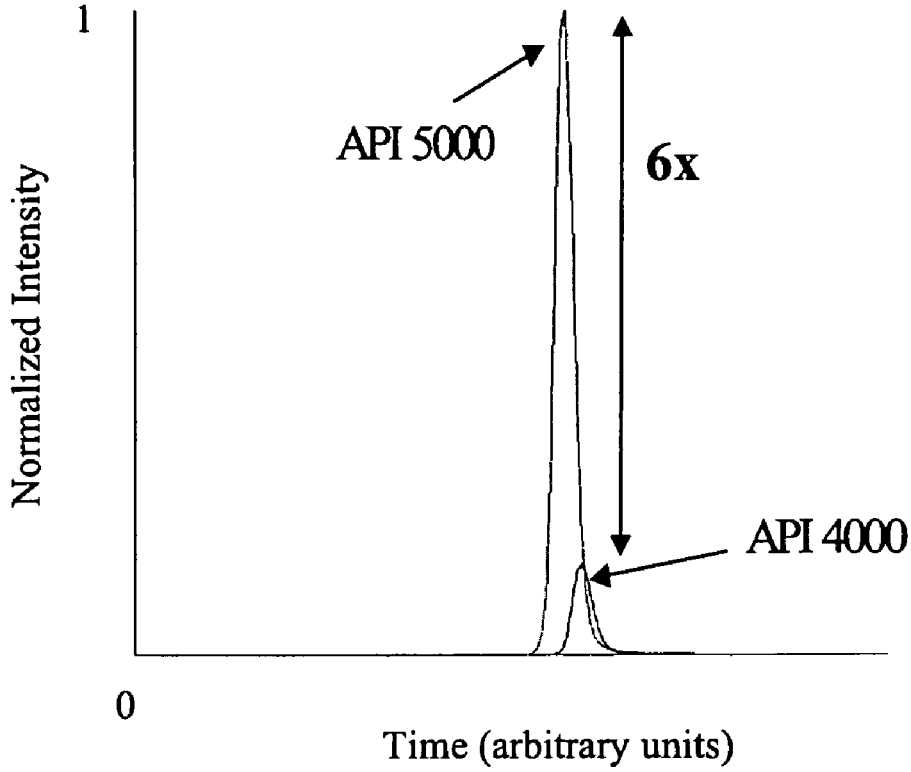
FIG. 15 is an intensity profile of a known compound demonstrating improved performance of a mass spectrometer in accordance with the present teachings over a prior art mass spectrometer.

FIG. 15 shows the sensitivity of a triple quadrupole mass spectrometer system in accordance with the present teachings resulting from a 50 pg injection of the compound Reserpine at a sample flow rate of 200 uL/minute, using the Multiple-Reaction-Monitoring mode of operation monitoring m/z 195 fragment ion of the m/z 609 precursor. The height of the signal peak can be a direct indication of the sensitivity of the system. The response from two separate experiments have been superimposed in FIG. 15, where the vertical axis shows the normalized intensity and the horizontal axis is a function of time in arbitrary units.

The first (lower) peak, labeled API 4000, shows the response on a prior art mass spectrometer, API 4000 triple quadrupole mass spectrometer, manufactured by Applied Biosystems/MDS Sciex, which uses an inlet aperture diameter of 0.32 mm and a skimmer diameter of 2.4 mm.

The second (larger) peak, indicated by the label API 5000, shows the response on a triple quadrupole mass spectrometer instrument in accordance with the present teachings, where the inlet aperture diameter has been increased to 0.6 mm, and an RF quadrupole ion guide was used to capture and focus the ions from the supersonic free jet according to the present teachings. In this example, the pressure in the ion guide region was 2.6 torr, the diameter of the ion guide was 4 mm, and the calculated maximum diameter of the barrel shock of the Mach disc according to Equation (1) was 4.2 mm. The increase of approximately six-fold, indicated by the label 6*x*, in sensitivity demonstrates the ability to achieve significantly better mass spectrometry performance in accordance with the present teachings.

Example 2

Figure 20:
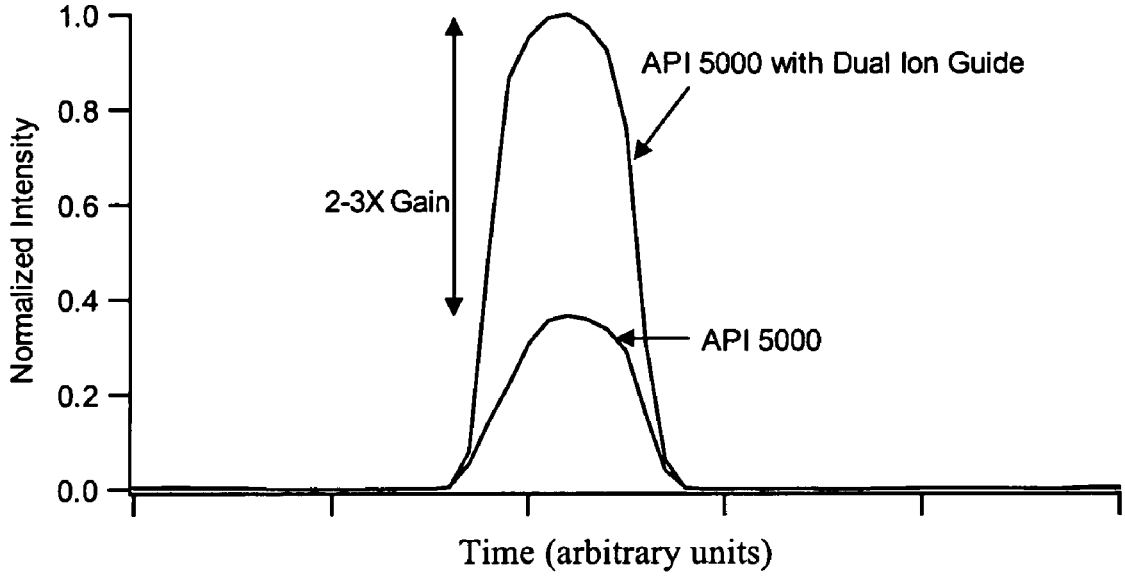
FIG. 20 is an intensity profile of a known compound demonstrating further improved performance of a mass spectrometer in accordance with the present teachings.

FIG. 20 shows the sensitivity of a triple quadrupole mass spectrometer system in accordance with the present teachings resulting from replacing the single ion guide 36 of FIG. 1 with a series of ion guides 36*d* and 36*e* and corresponding RF voltages of FIG. 16. Similar to FIG. 15, the results of FIG. 20 were from an infusion of 10 pg/uL of the compound Reserpine at a sample flow rate of 200 uL/minute, using the Multiple-Reaction-Monitoring mode of operation monitoring m/z 195 fragment ion of the m/z 609 precursor. The height of the signal peak can be a direct indication of the sensitivity of the system. The response from two separate experiments have been superimposed in FIG. 20, where the vertical axis shows the normalized intensity and the horizontal axis is a function of time in arbitrary units.

The first (lower) peak, labeled API 5000, shows the response similar to the response with the same label as indicated in FIG. 15. The second (larger) peak, indicated by the label API 5000 Dual Ion Guide, shows the response on the same triple quadrupole mass spectrometer system, however, the 4 mm ion guide was replaced by a 7 mm diameter first ion guide and a 4 mm diameter second ion guide. The length of the first ion guide was 7 mm and the length of the second ion guide was 5 mm. The increase of approximately 2–3 fold, indicated by the label 2–3*x*, in sensitivity demonstrates the ability to achieve significantly better mass spectrometry performance in accordance with the present teachings.

The invention claimed is:

1. A mass spectrometer comprising:

an ion source for generating ions in a high-pressure region;

a vacuum chamber comprising an inlet aperture for passing the ions from the high-pressure region into the vacuum chamber, and an exit aperture for passing ions from the vacuum chamber;

a series of multipole ion guides between the inlet and exit apertures and each of the ion guides in the series having a predetermined cross-section for defining an internal volume, the series comprising at least a first ion guide positioned nearest the inlet aperture and a second ion guide positioned nearest the exit aperture;

a power supply for providing a corresponding RF voltage to each of the ion guides for radially confining the ions within the internal volumes of the ion guides;

wherein the configuration of the inlet aperture and the pressure difference between the ion source and the vacuum chamber provides a supersonic free jet expansion downstream of the inlet aperture, the supersonic free jet expansion comprising a barrel shock of predetermined diameter; and wherein the cross-section of the first ion guide and the corresponding RF voltage applied to the first ion guide are configured for accepting at least 50% of the predetermined diameter of the barrel shock of the supersonic free jet expansion.

2. The mass spectrometer according to claim 1, wherein the cross-section of the second ion guide and the corresponding RF voltage applied to the second ion guide are configured for focusing the ions to the dimension of the exit aperture.

3. The mass spectrometer according to claim 2, wherein the cross-section of the second ion guide and the cross-section of the first ion guide has a relative ratio of less than or equal to 1.

4. The mass spectrometer according to claim 3, wherein the ratio is less than or equal to 0.6.

5. The mass spectrometer according to claim 1, wherein the multipole ion guides are selected from a quadrupole ion guide, a hexapole ion guide, an octapole ion guide, and any combination thereof.

6. The mass spectrometer according to claim 1, wherein each ion guide is a quadrupole ion guide.

7. The mass spectrometer according to claim 1, wherein the high-pressure region is substantially atmospheric pressure.

8. The mass spectrometer according to claim 7, wherein the vacuum chamber has a pressure between about 0.1 and 10 torr.

9. The mass spectrometer according to claim 8, wherein the inlet aperture is circular and has a diameter between about 0.1 and 1 mm.

10. The mass spectrometer according to claim 9, wherein the cross-section of the first ion guide forms an inscribed circle and has a diameter between about 1 and 8 mm.

11. The mass spectrometer according to claim 1, wherein the power supply comprises at least two separate power supplies for providing the corresponding RF voltages.

12. The mass spectrometer according to claim 1, further comprising a mass analyzer receiving ions passed from the vacuum chamber.

13. A mass spectrometer comprising:

an ion source for generating ions in a high-pressure region;

a vacuum chamber comprising an inlet aperture for passing the ions from the high-pressure region into the vacuum chamber, and an exit aperture for passing ions from the vacuum chamber;

a multipole ion guide between the inlet and exit apertures, the ion guide having an entrance cross-section and an exit cross-section for defining an internal volume, wherein the exit cross-section and the entrance cross-section has a relative ratio of less than 1;

a power supply for providing an RF voltage to the ion guide for radially confining the ions within the internal volume of the ion guide;

wherein the configuration of the inlet aperture and the pressure difference between the ion source and the vacuum chamber provides a supersonic free jet expansion downstream of the inlet aperture, the supersonic free jet expansion comprising a barrel shock of predetermined diameter; and wherein the entrance cross-section is configured for accepting at least 50% of the predetermined diameter of the barrel shock of the supersonic free jet expansion and the exit cross-section is configured for focusing the ions to the exit aperture.

14. The mass spectrometer according to claim 13, wherein the ratio is less than or equal to 0.4.

15. The mass spectrometer according to claim 13, wherein the ion guide is selected from a quadrupole ion guide, a hexapole ion guide, and an octapole ion guide.

16. The mass spectrometer according to claim 13, wherein the ion guide is a quadrupole ion guide.

17. A method for performing mass analysis comprising:

generating ions in a high pressure region;

passing the ions into a vacuum chamber comprising an inlet aperture for passing the ions from the high-pressure region into the vacuum chamber, and an exit aperture for passing ions from the vacuum chamber;

providing a series of multipole ion guides between the inlet and exit apertures, each ion guide in the series having a predetermined cross-section defining an internal volume, the series comprising at least a first ion guide positioned nearest the inlet aperture and a second ion guide positioned nearest the exit aperture;

applying a corresponding RF voltage to each ion guide for radially confining the ions within the internal volume of each ion guide;

wherein the configuration of the inlet aperture and the pressure difference between the high pressure region and the vacuum chamber provides a supersonic free jet expansion downstream of the inlet aperture, the supersonic free jet expansion comprising a barrel shock of predetermined diameter; and wherein the cross-section of at least a first ion guide in the series and the corresponding RF voltage are configured for accepting at least 50% of the predetermined diameter of the barrel shock of the supersonic free jet expansion.

18. The method for performing mass analysis according to claim 17, wherein the cross section of at least the second ion guide in the series and the corresponding RF voltage applied thereto are configured for focusing the ions to the dimension of the exit aperture.

19. The method of performing mass analysis according to claim 18, wherein the cross section of the second ion guide and the cross section of the first ion guide has a relative ratio of less than or equal to 1.

20. The method for performing mass analysis according to claim 19, wherein the ratio is less than or equal to 0.6.

* * * * *